United States Patent [19]

Traylor

[11] Patent Number: 5,038,979

[45] Date of Patent: Aug. 13, 1991

[54] GARMENT HANGER WITH SPACED SUPPORTS FOR INDEPENDENTLY STORING AND REMOVING MULTIPLE GARMENTS

[76] Inventor: Gary W. Traylor, 7567 Kings Run Rd., Sylvania, Ohio 43560

[21] Appl. No.: 489,696

[22] Filed: Mar. 7, 1990

[51] Int. Cl.[5] ..... A47G 25/18; A47G 25/28; A47G 25/16; A47G 25/14

[52] U.S. Cl. ..... 223/88; 223/85; 223/92; 223/95; D6/315; D6/319; D6/327; D6/318

[58] Field of Search ..... 211/113; 223/85, 88, 223/92, 95; 248/339; D6/315, 318, 319, 320, 324, 327

[56] References Cited

U.S. PATENT DOCUMENTS

| | | | |
|---|---|---|---|
| D. 250,161 | 11/1978 | Fullarton | D6/319 |
| 2,449,868 | 9/1948 | Waldman | 223/88 |
| 2,499,536 | 3/1950 | Stanton | 223/88 |
| 2,615,603 | 10/1952 | Durr | 223/88 |
| 2,685,991 | 8/1954 | Goza et al. | 223/88 |
| 2,686,620 | 8/1954 | Waldman | 223/88 |
| 2,881,964 | 4/1959 | Schneier | 223/88 |
| 2,903,169 | 9/1959 | Kearney | 223/88 |
| 2,990,985 | 7/1961 | Begley | 223/88 |
| 3,651,999 | 3/1962 | Fiocca | 223/88 |
| 4,310,096 | 1/1982 | Kohlepp | 223/88 |
| 4,638,931 | 1/1987 | Rieser | 223/88 |

FOREIGN PATENT DOCUMENTS

| | | | |
|---|---|---|---|
| 1336527 | 10/1962 | France | 223/95 |
| 680333 | 4/1950 | United Kingdom | 223/88 |
| 723659 | 2/1955 | United Kingdom | 223/88 |

*Primary Examiner*—Werner H. Schroeder
*Assistant Examiner*—Bibhu Mohanty
*Attorney, Agent, or Firm*—Marshall & Melhorn

[57] ABSTRACT

A combination clothes hanger comprising a collar portion, a pair of oppositely disposed shoulder supports downwardly diverging from the collar portion over which a jacket can be draped, and a generally horizontally disposed bar held by a bracket extending from the collar portion over which a pair of trousers can be positioned outside of and anterior to the jacket. The collar portion includes a conventional wire hook or other means extending upwardly therefrom for suspending the hanger from a support.

4 Claims, 2 Drawing Sheets

GARMENT HANGER WITH SPACED SUPPORTS FOR INDEPENDENTLY STORING AND REMOVING MULTIPLE GARMENTS

FIELD OF THE INVENTION

This invention pertains generally to a clothes hanger, and more particularly to a combination clothes hanger for a jacket and trousers.

DESCRIPTION OF THE PRIOR ART

Conventional combination jacket and trouser hangers are generally formed with upper and lower sections. The upper section includes opposed arms downwardly arched for supporting a jacket or coat thereon, and the lower section consists of a horizontal bar over which a pair of trousers can be positioned. Though widely in use, this type of hanger is disadvantageous in that the jacket or coat covers the horizontal bar over which the trousers are positioned. Thus, the jacket or coat must first be removed in order to remove the trousers from the bar. Likewise, the jacket or coat cannot be replaced on the hanger until after the trousers have been repositioned on the bar, or else the jacket or coat must be removed before the trousers can be placed in position. This arrangement is obviously disadvantageous in that a person dressing normally puts the trousers on before the jacket or coat, and reverses the sequence when undressing.

Several attempts have been made to resolve this problem. U.S. Pat. No. 2,499,536 to Stanton describes and illustrates a garment hanger having a removable rack for the trousers and vest mounted below the brace over which the coat is positioned. However, the trousers are still positioned within the jacket or coat, which must be opened or removed in order to remove the trouser and vest rack from its coupling.

U.S. Pat. No. 4,638,931 to Rieser describes and illustrates a combination garment hanger having shoulder supports over which a coat is positioned below a horizontal bar for the trousers. In this arrangement, the trousers may be removed without first removing the coat or jacket. However, the trousers obscure and cover the coat or jacket positioned on the supports beneath them. Thus, this arrangement is disadvantageous in that it is very difficult to remove the coat or jacket prior to or without removing the trousers, as when the user wishes to wear a sport coat or blazer in combination with a particular pair of trousers not hung on the same hanger.

SUMMARY OF THE INVENTION

In accordance with the invention, there is provided a combination clothes hanger comprising a collar portion, a pair of oppositely disposed shoulder supports downwardly diverging from the collar portion over which a jacket can be draped, and a generally horizontally disposed bar held by brackets extending from the collar portion over which a pair of trousers can be positioned outside of and anterior to the jacket. The collar portion includes a conventional wire hook or other means extending upwardly therefrom for suspending the hanger from a support.

When using the clothes hanger of the present invention, the trousers may be removed from and replaced on the horizontally disposed bar without disturbing the jacket or coat draped over the shoulder supports in any way. Likewise, the jacket or coat may be removed from and replaced on the shoulder supports without disturbing the trousers positioned on the bar. The user may therefore easily access the jacket and trousers in the order required by a given situation.

It is an object of the present invention to provide an improved combination clothes hanger for a jacket and trousers.

Another object of the invention is to provide such clothes hangers which permit the removal and replacement of the trousers without disturbing the jacket.

Still another object of the invention is to provide such clothes hangers which permit the removal and replacement of the jacket and trousers, separately, in either order.

Other objects and advantages will become more apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENTS

Figure 1:
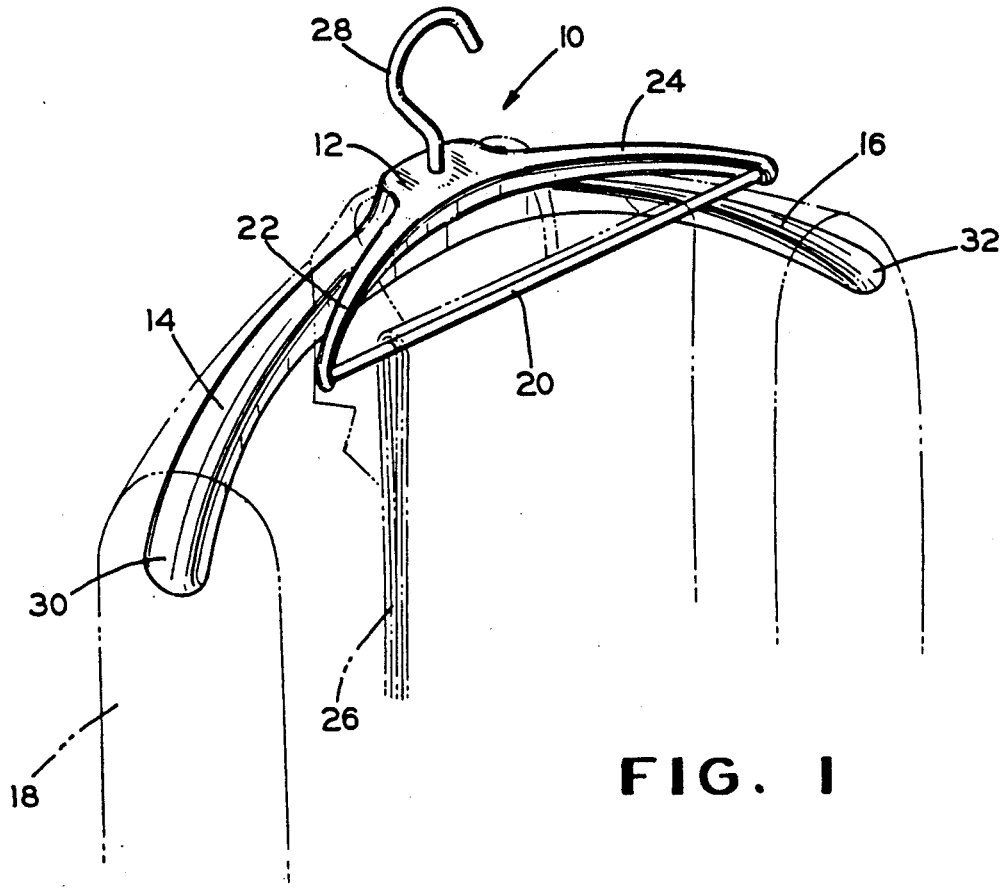
FIG. 1 is a perspective view of a combination clothes hanger of the present invention with a jacket and trousers shown in phantom.

Referring now to the drawings, there is illustrated in FIG. 1 a combination clothes hanger embodying the present invention shown generally at 10. The hanger 10 includes a collar portion 12, a pair of oppositely disposed shoulder supports 14 and 16 diverging from the collar portion 12 over which a jacket 18 (shown in phantom) can be draped, and a generally horizontally disposed bar 20 held by brackets 22 and 24 extending from the collar portion 12 over which a pair of trousers 26 (shown in phantom) can be positioned outside of and anterior to the jacket 18. The collar portion 12 is provided with a wire or the like hook 28 extending upwardly therefrom for suspending the hanger 10 from a support (not shown).

The collar portion 12, shoulder supports 14 and 16, and brackets 22 and 24 are preferably integrally molded of a suitable rigid plastic material to form a unitary combination clothes hanger. Suitable plastic materials include but are not limited to reinforced materials of polyethylene, polyvinylchloride, polypropylene, acrylnitrile-butadiene-styrene polymers, polyethylene terephthalate, polybutylene terephthalate, polycarbonate, acetate and other thermoplastic and thermoset materials with comparable properties, as examples. If desired, the hanger 10 may be formed of wood, aluminum, or other suitable material.

Figure 2:
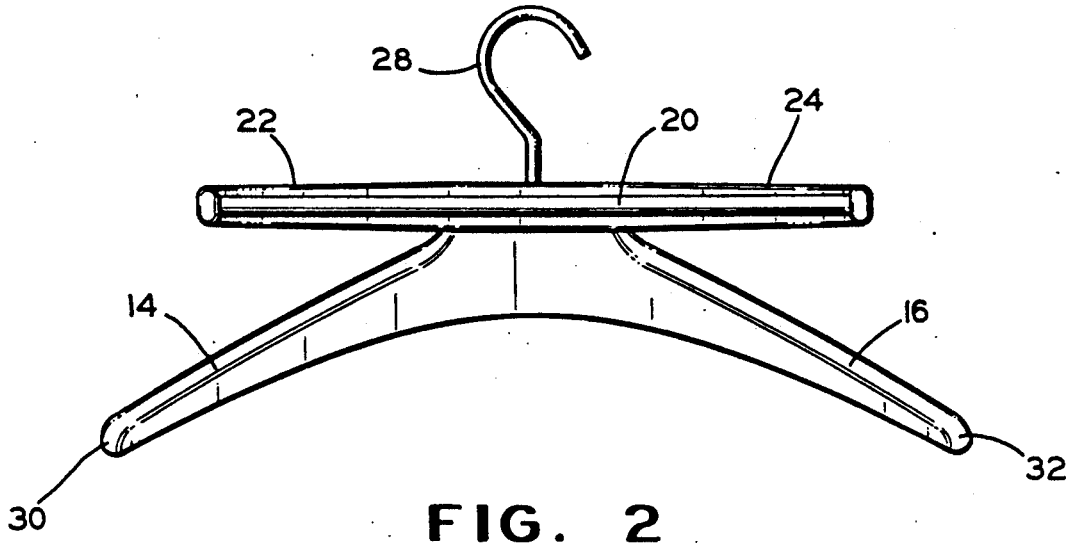
FIG. 2 is a front elevational view of the hanger shown in FIG. 1.
Figure 3:
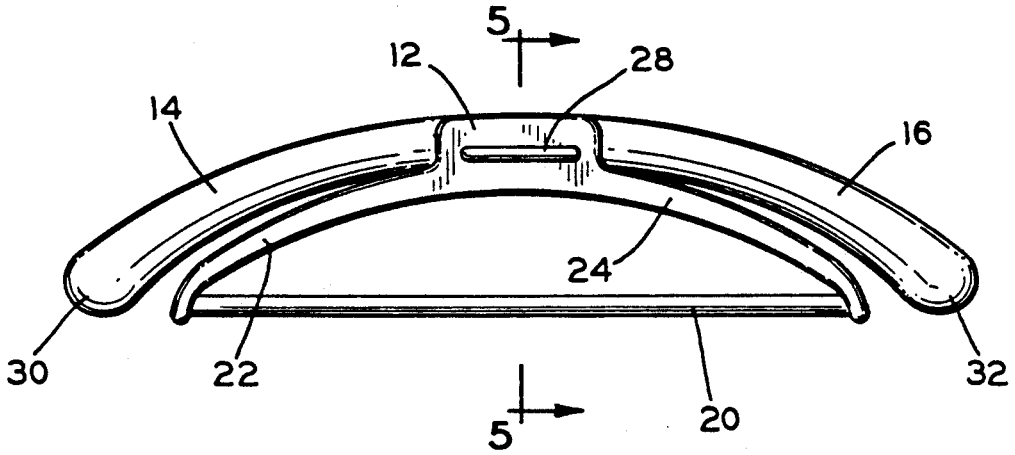
FIG. 3 is a top plan view of the hanger shown in FIG. 1.
Figure 4:
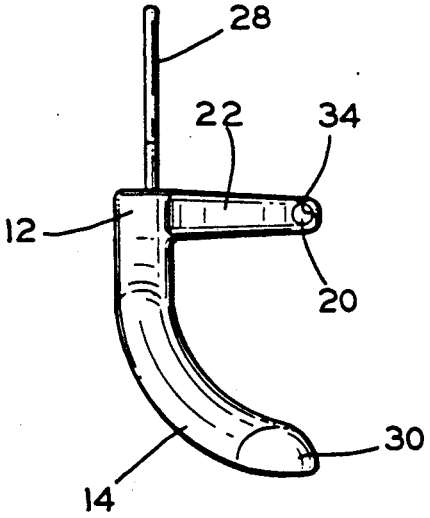
FIG. 4 is a left side elevational view of the hanger shown in FIG. 1.

As can be seen from FIGS. 2,4, the shoulder supports 14 and 16 diverge downwardly and forwardly from the collar portion 12. Support is thereby provided for the shoulders of the jacket 18 in the same manner as when the jacket is being worn, preventing the wrinkling or creasing of the jacket 18 while it is positioned on the hanger 10. The distal ends 30 and 32 of the shoulder supports 14 and 16 are preferably rounded so as prevent creasing of the shoulders of the jacket 18.

Figure 5:
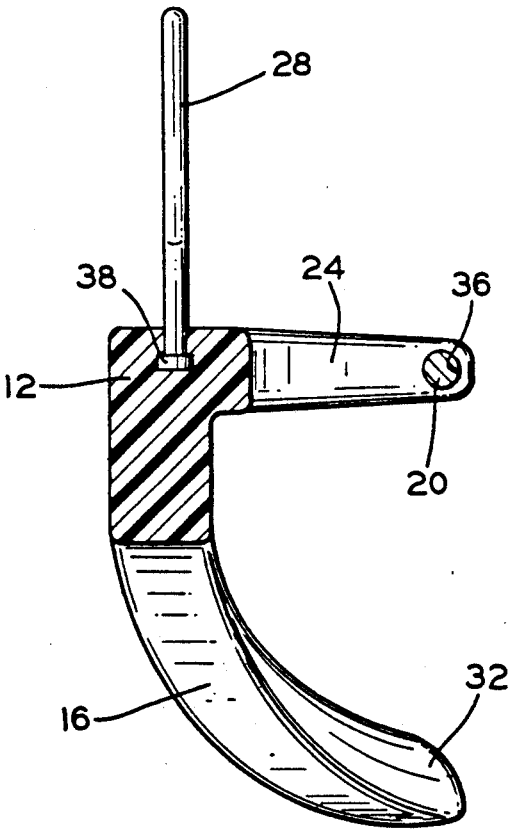
FIG. 5 is an enlarged sectional view taken along line 5—5 of FIG. 3.

A generally horizontally disposed bar 20 is provided to receive the trousers 26. As shown in FIG. 5, the bar 20 is preferably formed with a circular cross section to prevent creasing of the trousers 26 while positioned on the bar 20. The bar 20 is supported at opposite ends by brackets 22 and 24, which extend forwardly from the collar portion 12 a distance sufficient so that the trousers 26, when positioned on the bar 20, hang in a plane outside of and anterior to the confines of jacket 18 draped over shoulder supports 14 and 16. Brackets 22 and 24 may be coupled to the ends of the bar 20 by any conventional means. In a preferred embodiment, the distal ends of brackets 22 and 24 are provided with apertures 34 and 36, each of circular cross section with a diameter substantially equal to or slightly greater than the diameter of the ends of bar 20. The ends of bar 20 are inserted into apertures 34 and 36 to join the bar 20 to brackets 22 and 24, for example by a friction fit or through the use of a suitable adhesive.

The collar portion 12 is provided with means extending upwardly therefrom for suspending the hanger 10 from a support, such as a rod (not shown). In a preferred embodiment, the collar portion 12 is provided with a wire hook 28. As shown in FIG. 5, the proximal end of the wire hook 28 may be disposed within the collar portion 12 and may be provided with an annular lip 38 to prevent separation of the wire hook 28 from the collar portion 12.

When a jacket 18 and trousers 26 are positioned on the hanger 10 as illustrated in FIG. 1, either may be easily accessed without having to disturb the other. With the trousers 26 positioned outside of and anterior to the jacket 18, the trousers 26 may be removed from and replaced on the bar 20 without having to open or remove the jacket 18. Likewise, the jacket 18 may be removed from and replaced on shoulder supports 14 and 16 without having to remove the trousers 26. The user may easily access the jacket 18 and trousers 26 in the order required by a given situation.

It is to be understood that the form of the invention herewith shown and described is to be taken as an illustrative embodiment only of the same, and that various changes in the shape, size and arrangement of parts, as well as various procedural changes, may be resorted to without departing from the spirit of the invention.

I claim:

1. A combination clothes hanger, comprising a collar portion having means extending upwardly therefrom for suspending said hanger from a support, said means including a hooked portion adapted to overlie said support, a pair of oppositely disposed shoulder supports downwardly diverging from said collar portion over which a jacket can be draped, and a generally horizontally disposed bar rigidly affixed to the collar portion in spaced relation to said shoulder supports by a bracket extending from said collar portion over which a pair of trousers can be positioned outside of and anterior to the jacket.

2. The hanger as claimed in claim 1, wherein said collar portion, shoulder supports and bracket are integrally molded of a rigid plastic material.

3. The hanger as claimed in claim 1, wherein said plastic material is polyvinylchloride.

4. The hanger as claimed in claim 1, wherein the distal ends of said shoulder supports are spaced from each other a distance greater than the length of said bar.

* * * * *